US008528753B2

(12) United States Patent
Woolley, II

(10) Patent No.: US 8,528,753 B2
(45) Date of Patent: Sep. 10, 2013

(54) SHOWER ROD SNAP-FIT ASSEMBLY

(75) Inventor: Patrick Woolley, II, Rockford, MI (US)

(73) Assignee: WT International, Inc., Rockford, MI (US)

( * ) Notice: Subject to any disclaimer, the term of this patent is extended or adjusted under 35 U.S.C. 154(b) by 141 days.

(21) Appl. No.: 12/645,939

(22) Filed: Dec. 23, 2009

(65) Prior Publication Data

US 2011/0147326 A1 Jun. 23, 2011

(51) Int. Cl.
*A47H 1/022* (2006.01)

(52) U.S. Cl.
USPC ..... 211/105.2; 211/105.3; 211/123

(58) Field of Classification Search
USPC ..... 211/105.1–105.6, 119.009, 119.011, 211/123, 124, 206, 182; 248/261, 262, 264, 248/265, 251, 252; 4/576.1, 577.1, 611
See application file for complete search history.

(56) References Cited

U.S. PATENT DOCUMENTS 1,201,799 A * 10/1916 Bond ..... 248/262
1,320,007 A * 10/1919 Hills ..... 248/262
1,424,337 A * 8/1922 Boye ..... 211/105.2
3,062,157 A * 11/1962 Woods ..... 410/149
3,074,740 A * 1/1963 Zastrow ..... 410/151
3,384,333 A * 5/1968 Bohlman et al. ..... 248/251
3,527,352 A * 9/1970 De Lapa ..... 211/1.3
3,643,988 A * 2/1972 Ingvartsen ..... 403/49
4,754,504 A * 7/1988 Cellini ..... 4/610
5,702,010 A * 12/1997 Liang ..... 211/105.1
6,131,213 A * 10/2000 Sarff ..... 4/576.1
7,124,451 B2 * 10/2006 Moore ..... 4/576.1
2004/0256338 A1 * 12/2004 McGarry et al. ..... 211/94.01
2008/0222791 A1 * 9/2008 Godbersen ..... 4/576.1
2009/0020671 A1 * 1/2009 Xu ..... 248/262
2009/0206220 A1 * 8/2009 Forrest et al. ..... 248/251

* cited by examiner

*Primary Examiner* — Darnell Jayne
*Assistant Examiner* — Stanton L Krycinski
(74) *Attorney, Agent, or Firm* — Barnes & Thornburg LLP

(57) ABSTRACT

A shower rod snap-fit assembly (200) includes a shower curtain rod (101) having at least one first aperture (202) at each end of the rod. A resilient spring (201) is used for insertion into each end of the shower curtain rod (101) such that portions of the resilient spring (201) extend through the at least one first aperture (202). A base member (105) is used for attachment to a wall and has plurality of second apertures (205). In use, the shower curtain rod (101) is inserted into the base member (205) such that the plurality of second apertures (205) receive portions of the resilient spring (201) extending from the at least one first aperture (202) for holding the shower curtain rod (101) into a fixed position.

17 Claims, 3 Drawing Sheets

SHOWER ROD SNAP-FIT ASSEMBLY

FIELD OF THE INVENTION

The present invention relates generally to shower curtain rod assemblies and more specifically to a shower curtain rod assembly using a snap-fit mechanism for facilitating rapid assembly and disassembly of the shower curtain rod.

BACKGROUND OF THE INVENTION

Conventional shower curtain rods are used at the entrance to a bath tub/shower and work in combination with a plastic or rubber shower curtain that drape below the rod. This assembly not only provides privacy but prevents water from splashing or exiting the tub area. Typically, the shower curtain rod utilizes a one-piece construction where a wall-mounting base and rod is rigidly fastened between opposing shower walls. This type of assembly can involve a great deal of labor in its installation since the rod must often be held into a fixed position at both of its ends while its base members are secured to a wall. Still other types of shower rods work to expand between the walls to frictionally hold the rod into a fixed position without mechanical attachment. These types of shower rods can easily move or fail at inopportune times while bearing the weight of a moveable shower curtain. Accordingly, a new type of show curtain assembly is needed for allowing a user additional alternatives in its assembly and use.

BRIEF DESCRIPTION OF THE FIGURES

The accompanying figures, where like reference numerals refer to identical or functionally similar elements throughout the separate views and which together with the detailed description below are incorporated in and form part of the specification, serve to further illustrate various embodiments and to explain various principles and advantages all in accordance with the present invention.

Figure 1:
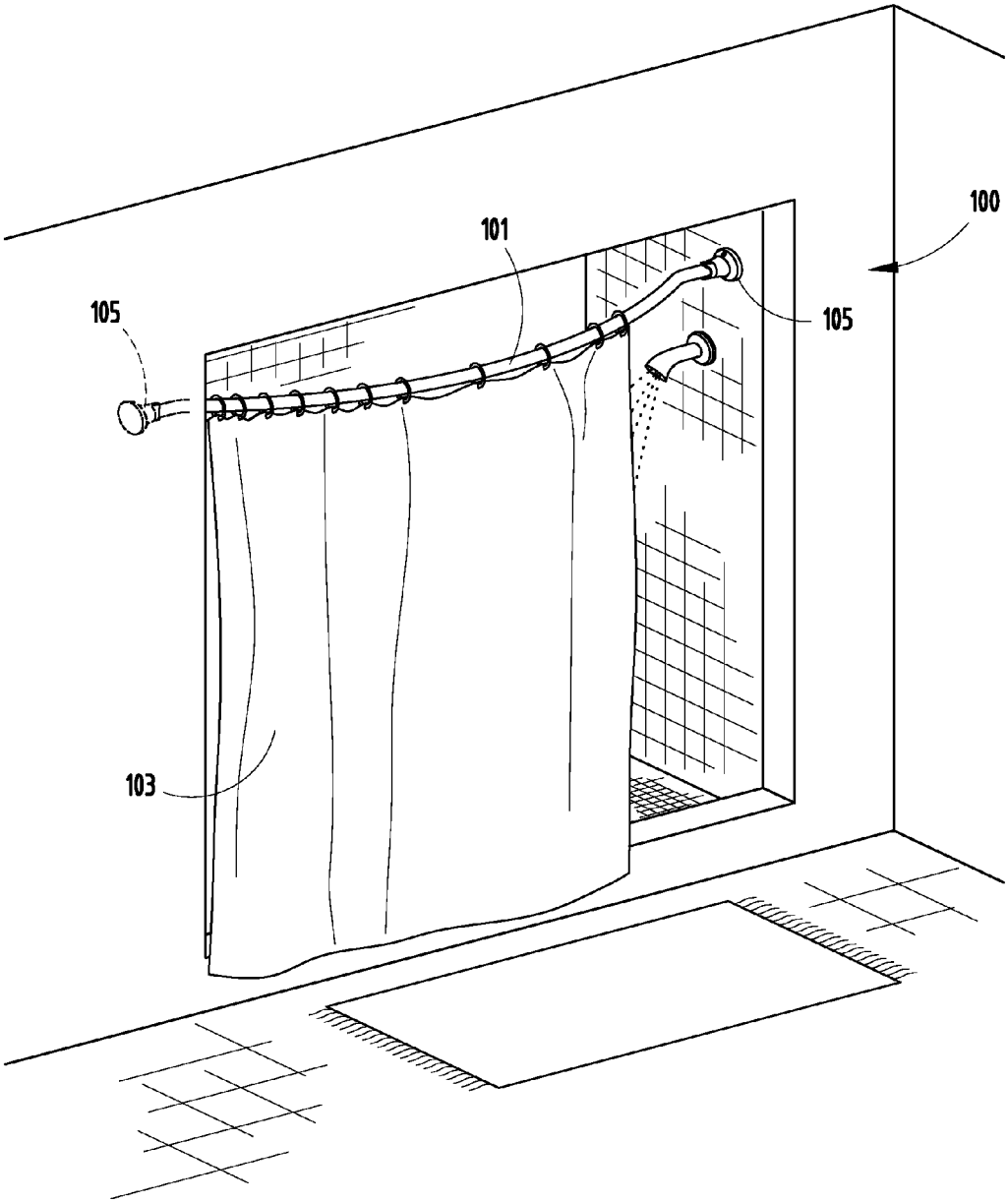
FIG. 1 is a perspective view of the shower curtain in accordance with an embodiment of the invention.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

DETAILED DESCRIPTION OF PREFERRED EMBODIMENT

Before describing in detail embodiments that are in accordance with the present invention, it should be observed that the embodiments reside primarily in combinations of method steps and apparatus components related to a shower rod snap-fit assembly. Accordingly, the apparatus components and method steps have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

In this document, relational terms such as first and second, top and bottom, and the like may be used solely to distinguish one entity or action from another entity or action without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "comprises . . . a" does not, without more constraints, preclude the existence of additional identical elements in the process, method, article, or apparatus that comprises the element.

FIG. 1 is a perspective view of the shower curtain and rod in accordance with an embodiment of the invention. The shower curtain rod system 100 includes a curved shower curtain rod 101 that supports a shower curtain 103. Although shown as a curved rod, it will be evident to those skilled in the art that the present invention is application to a straight shower curtain rod as well. However, the curved shower curtain rod 101 is advantageous in that when used with a shower curtain, the curtain bows away from the tub at the center of the rod giving the user a perception of having more room or space in the shower while behind the curtain. The curved shower rod 101 is typically manufactured of a plastic or metallic material in a tubular form in multiple pieces so to have a slight taper at its center for providing a substantially telescoping rod for adjusting its overall length. A telescoping rod allows the shower curtain rod 101 to be conveniently sized in length to fit between walls of a shower or bathtub area. As will be described herein, at the end of each shower rod 101, a "snap-fit" type assembly is used to construct and/or set-up the shower rod 101 into a wall base mount 105 without the need of multiple persons or helpers that normally would be required in such an installation. The invention allows the shower curtain rod 101 to be held into a fixed position while still allowing a homeowner or other user to quickly attach and/or detach the shower curtain rod 101 without the need for special tools or other equipment.

Figure 2:
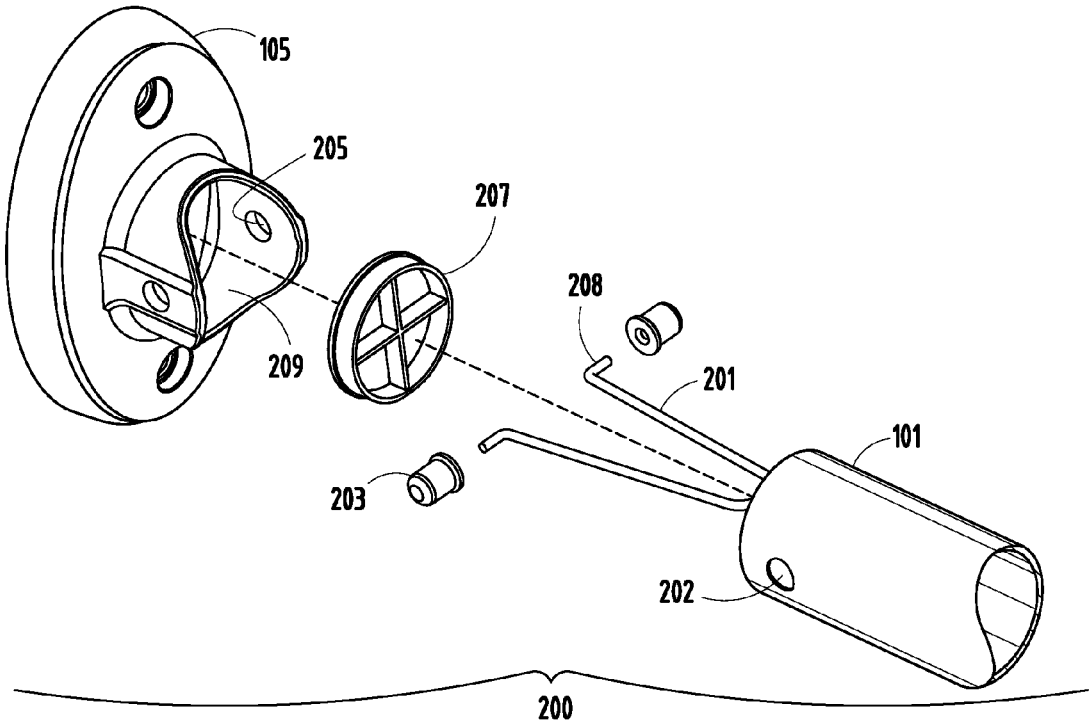
FIG. 2 is an exploded view of the snap-fit assembly in accordance with an embodiment of the invention.

FIG. 2 is an exploded view of the snap-fit assembly in accordance with an embodiment of the invention. The snap-fit assembly 200 operates in combination with a wall base mount 105 for holding the shower rod 101 into a fixed position when snap-fit therein. The snap-fit assembly 200 includes a pair of caps or buttons 203 that work in combination with a substantially U-shaped resilient spring 201. In use, each button 203 is fastened or engaged with a pin 208 located on the end portion of the spring 201. During assembly, the closed end of the resilient spring 201 is inserted in an open end of the shower rod 101 to a point where the buttons 203 are forced through and extend from a corresponding aperture 202. This allows the spring 201 and button 203 to be held in place by its aperture 202 by the rigid tubular construction of the rod 101. Once in position, an end cap 207 is then frictionally engaged within an end of the shower rod to cover the opening to the rod 101. As will be described herein, the rod 101 is then inserted into a channel 209 formed within the wall base mount 105.

Figure 3:
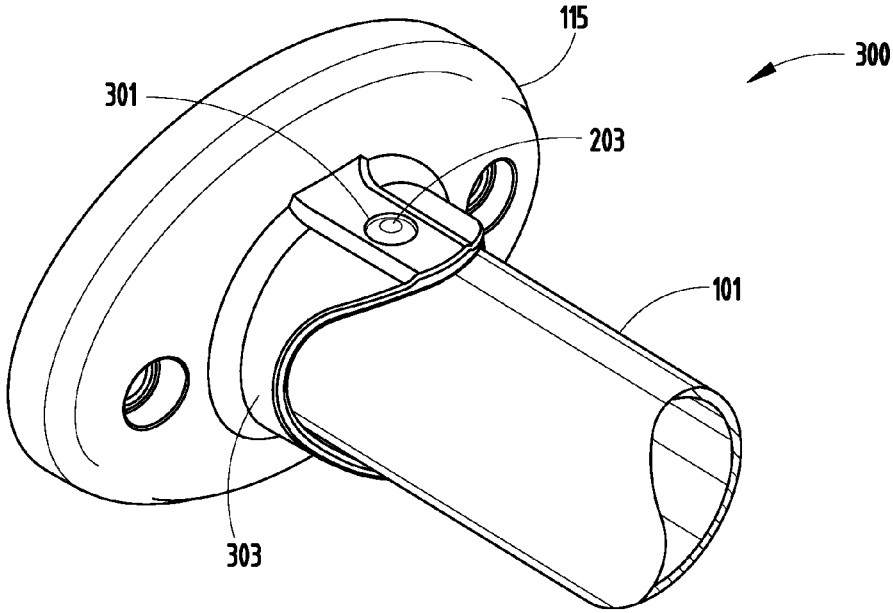
FIG. 3 is a perspective view of the shower rod engaged within the wall mount base in accordance with an embodiment of the invention.

FIG. 3 is a perspective view of the shower rod engaged within the wall mount base in accordance with an embodiment of the invention. The mounting assembly 300 includes the shower rod 101 inserted with a channel formed by cup section 303 that extends from the face of the wall base mount 105. In one embodiment, the cup section 303 has uneven sides allowing the buttons 203 to protrude from each side of a corresponding base aperture 301 when inserted therein. By compressing the buttons 203 and spring 201, the buttons 203 can be extracted from the base apparatus 301 by using a substantially mild pulling force. This allows the shower rod 101 to be detached and disassembled from the cup section 303 in the wall base mount 105. Hence, by using such a snap-fit locking system between the wall-mounting base and curtain rod, this enables for an easier installation or disassembly of the curtain rod 101 with less labor and fewer tools involved for cleaning and/or maintenance.

Figure 4A:
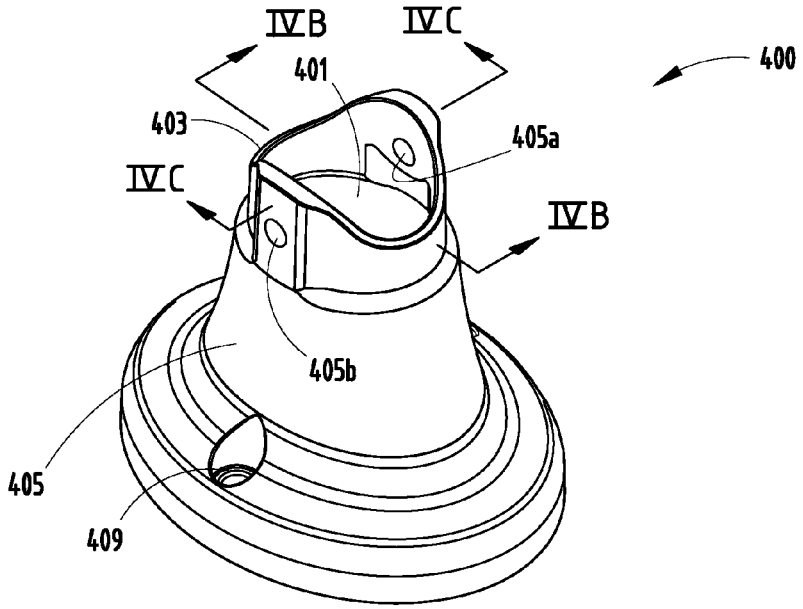
FIGS. 4A, 4B and 4C are a perspective view, top view and side view respectively of the wall mount base in accordance with an alternative embodiment of the invention.
Figure 4B:
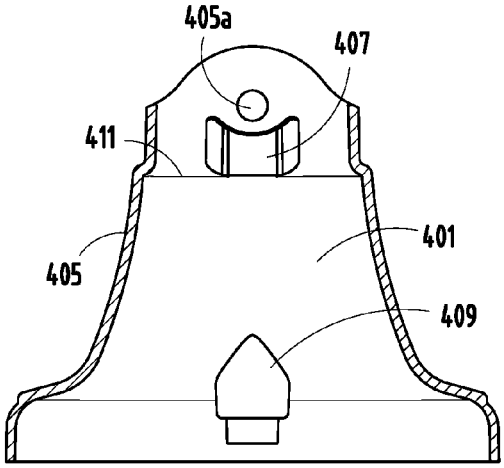
Figure 4C:
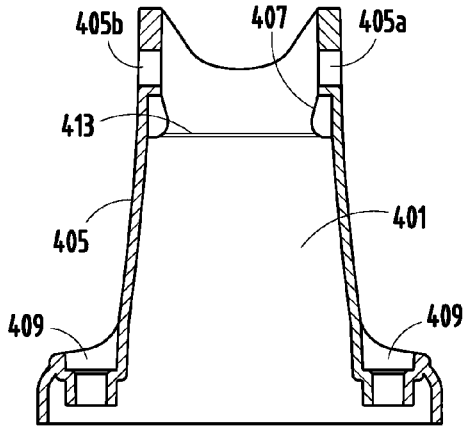

FIGS. 4A, 4B and 4C are views illustrating an alternative embodiment of the wall mount base as described herein. FIG. 4A is a perspective view of the wall mount base while FIG. 4B shows a cross-sectional inside view of a first half of the wall mount base through section lines IVB-IVB shown in FIG. 4A. FIG. 4C shows a cross-sectional inside view of a second half of the wall mounted base through lines IVC-IVC shown in FIG. 4A. More specifically, FIG. 4A illustrates the wall base mount 400 having a tapered wall 401 and cup section 403. As described herein, the base apertures 405*a*, 405*b* work with the shower rod (not shown) allowing it to be snap-fit into a fixed position. FIG. 4B illustrates a first half of the base showing the inside of the tapered wall 401 and inside of wall aperture 405*a*. A protuberance 407 works to raise the support area used by the wall aperture 405*a* allowing for the base apertures 405*a*, 405*b* to be set at the correct distance apart. A fastening aperture 409 is used in connection with a mounting screw (not shown) for attaching the wall base mount to the surface of a wall or other structure (not shown). A first stop 411 joins or mates with a corresponding stop for allowing the shower rod end to abut at a fixed point within the wall mount base. In FIG. 4C, the inside of the second half of the base illustrates a second stop 413 used for mating with the first stop 411 when the halves of the wall mount base are joined together like shown in FIG. 4A. The first stop 411 and second stop 413 operate to prevent the shower rod (not shown) from extending beyond a predetermined point into the wall mount base. When assembled, the buttons (not shown) can easily snap-fit within their corresponding base apertures 405*a*, 405*b* allowing easy assembly and disassembly.

As will be evident to those skilled in the art, the shower rod snap-fit assembly including its wall mount bases may also be supplied as individual parts, which can be installed part-by-part with minimum labor. In use, once the wall mount bases are fixed onto the wall, the curtain rod can be easily snap-fit into the wall-mounting bases without tools. Once the curtain rod is snap-fit into the mounted bases on the wall, the curtain rod is held into a substantially rigid position for holding the shower curtain. Meanwhile, it is also easy to detach the shower curtain rod from the mounting bases by compressing the snap-fit buttons and sliding out the rod for cleaning and maintenance.

In the foregoing specification, specific embodiments of the present invention have been described. However, one of ordinary skill in the art appreciates that various modifications and changes can be made without departing from the scope of the present invention as set forth in the claims below. Accordingly, the specification and figures are to be regarded in an illustrative rather than a restrictive sense, and all such modifications are intended to be included within the scope of present invention. The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

The invention claimed is:

1. A shower rod snap-fit assembly comprising:

a shower curtain rod having at least one first aperture at each end of the rod;

at least one resilient substantially U-shaped spring having an open end and closed end for insertion of the closed end into each end of the shower curtain rod such that ends of the open end of the at least one resilient spring extend through the at least one first aperture for holding the at least one resilient spring into a substantially fixed position inside the shower curtain rod;

a base member having a circular taper and a plurality of second apertures and a plurality of protuberances to raise a support area used by the plurality second apertures, said protuberances extend beyond the circular taper where the base member is used for attachment to a wall; and wherein the shower curtain rod is inserted into the base member such that a stop and the protuberances position the plurality of second apertures to receive said ends of the at least one resilient spring extending from the at least one first aperture for holding the shower curtain rod into a fixed position in relation to the wall.

2. A shower rod snap-fit assembly as in claim 1, further comprising at least one button for engaging a portion of the at least one resilient spring end that extends from the at least one first aperture.

3. A shower rod snap-fit assembly as in claim 1, further comprising an end cap for sealing the end of the shower curtain rod.

4. A shower rod snap-fit assembly as in claim 1, wherein the shower curtain rod has a curved shape.

5. A shower rod snap-fit assembly as in claim 1, wherein a portion of the resilient spring extending through at least one of the plurality of second apertures is compressed for releasing the shower curtain rod from the base member.

6. A shower rod snap-fit assembly as in claim 1, wherein the base member includes a channel for receiving the shower curtain rod.

7. A shower rod snap-fit assembly as in claim 6, wherein the channel includes said stop for positioning the shower curtain rod within the channel.

8. A shower curtain rod snap-fit assembly comprising:

a bowed shower rod having a plurality of rod apertures located at each end of the rod;

a base member having a circular taper and a plurality of base apertures and a plurality of protuberances to raise a support area used by the plurality of base apertures, said protuberances extend beyond the circular taper where the base member is used for mounting to a wall;

first and second substantially U-shaped springs, each having an open end and a closed end so that the closed end of each of said first and second substantially U-shaped springs is inserted into a respective end of the curved shower rod;

a button engages an end pin portion located at each open end of the first and second substantially U-shaped springs for engaging said rod apertures and holding the first and second substantially U-shaped springs into a substantially fixed position within the shower rod; and wherein the shower rod is inserted into the base member against a stop so that the button is snap-fit into one of the plurality of base apertures located at one of said protuberances for holding the shower rod into a fixed position in relation to a wall.

9. A shower curtain rod snap-fit assembly as in claim 8, further comprising an end cap for sealing the end of the shower rod.

10. A shower curtain rod snap-fit assembly as in claim 8, wherein the button extending through one of said base apertures can be compressed for releasing the shower curtain rod from the base member.

11. A shower curtain rod snap-fit assembly as in claim 8, wherein the base member includes a channel for receiving the shower rod.

12. A shower curtain rod snap-fit assembly as in claim 11, wherein the channel includes said stop for positioning the shower rod within the channel.

13. A shower curtain rod snap-fit assembly comprising:

a telescoping shower curtain rod having a plurality of rod apertures at each of its ends;

a substantially U-shaped spring with an open end and closed end so that the closed end is inserted into one of the ends of the shower curtain rod and having a plurality of end pin sections such that said end pin sections at the open end of said spring extend through each one of the plurality of rod apertures for holding the spring into a substantially fixed position within the curtain rod;

at least one button for covering at least one of the plurality of end pin sections;

an end cap for covering one of the ends of the shower curtain rod;

a base member having a stop, a circular taper and a plurality of base apertures and a plurality of protuberances to raise a support area used by the plurality of base apertures, said protuberances extend beyond the circular taper where the base member is used for mounting to a wall; and wherein the end of the shower curtain rod with said substantially U-shaped spring is inserted into the base member to the stop so that the at least one button snap-fits into at least one of the plurality of base apertures located at the protuberances for holding the shower rod into a fixed position in relation to a wall.

14. A shower curtain rod snap-fit assembly as in claim 13, wherein the telescoping shower rod is curved in shape.

15. A shower curtain rod snap-fit assembly as in claim 13, wherein said closed end is rounded.

16. A shower curtain rod snap-fit assembly as in claim 13, wherein the base member includes a channel for receiving the shower curtain rod.

17. A shower curtain rod snap-fit assembly as in claim 16, wherein said channel includes said stop for positioning the shower curtain rod in the channel.

* * * * *